US010558168B2

(12) United States Patent
Ohkubo et al.

(10) Patent No.: US 10,558,168 B2
(45) Date of Patent: Feb. 11, 2020

(54) IMAGE FORMING APPARATUS FOR TRANSFERRING ELECTROPHOTOGRAPHIC TONER IMAGES

(71) Applicant: CANON KABUSHIKI KAISHA, Tokyo (JP)

(72) Inventors: Takateru Ohkubo, Susono (JP); Masaki Seto, Gotemba (JP)

(73) Assignee: Canon Kabushiki Kaisha, Tokyo (JP)

( * ) Notice: Subject to any disclaimer, the term of this patent is extended or adjusted under 35 U.S.C. 154(b) by 395 days.

(21) Appl. No.: 15/222,642

(22) Filed: Jul. 28, 2016

(65) Prior Publication Data

US 2017/0031275 A1 Feb. 2, 2017

(30) Foreign Application Priority Data

Jul. 31, 2015 (JP) ..... 2015-152146

(51) Int. Cl.
*G03G 21/18* (2006.01)

(52) U.S. Cl.
CPC ..... *G03G 21/185* (2013.01)

(58) Field of Classification Search
None
See application file for complete search history.

(56) References Cited

U.S. PATENT DOCUMENTS 5,608,498 A * 3/1997 Nagase ..... G03G 15/011 347/138
8,254,805 B2 * 8/2012 Mizuno ..... G03G 21/185 399/111
2014/0093257 A1 * 4/2014 Seto ..... G03G 21/1892 399/25
2014/0169824 A1 * 6/2014 Seto ..... G03G 21/185 399/90
2014/0227004 A1 * 8/2014 Taba ..... G03G 21/185 399/111
2016/0098008 A1 * 4/2016 Yuan ..... G03G 21/1647 399/167
2017/0031312 A1 * 2/2017 Seto ..... G03G 21/185
2018/0120765 A1 * 5/2018 Seto ..... G03G 21/1842

FOREIGN PATENT DOCUMENTS

JP H08-220824 A 8/1996

* cited by examiner

*Primary Examiner* — David M. Gray
*Assistant Examiner* — Geoffrey T Evans
(74) *Attorney, Agent, or Firm* — Canon U.S.A., Inc. IP Division

(57) ABSTRACT

An image forming apparatus including a cartridge having an image carrying member, and an apparatus main body from which the cartridge is capable of being detached in a longitudinal direction of the cartridge. While being positioned such that a first end side of the cartridge is in contact with a positioning portion of a frame, the cartridge that has been inserted when a door is in an open position is disposed under an intermediate transfer body such that a distance to a surface of the intermediate transfer body opposing the cartridge is greater on a second end side than on the first end side, and by moving the door to a closed position, the cartridge is pivoted with urging force of an urging member and the image carrying member is made to come into contact with the intermediate transfer body.

13 Claims, 6 Drawing Sheets

IMAGE FORMING APPARATUS FOR TRANSFERRING ELECTROPHOTOGRAPHIC TONER IMAGES

BACKGROUND OF THE INVENTION

Field of the Invention

The present disclosure relates to an image forming apparatus adopting an electrophotographic image forming method.

Description of the Related Art

Typically, an image forming apparatus needs to have toner supplied thereto and maintenance to be performed on the various process members thereof. There is a process cartridge system that is in practical use in which, in order to facilitate supply of toner and maintenance, a photosensitive drum, a charging member, a developing member, a cleaning member, and the like are formed into a cartridge inside a frame. With the above, a process cartridge (hereinafter, referred to as a cartridge) can be detached from the main body of the image forming apparatus (hereinafter, referred to as an apparatus main body). As a result, the maintenance of the apparatus can be carried out by the user and an image forming apparatus with excellent usability can be provided. Accordingly, the process cartridge system is widely used in image forming apparatuses.

Furthermore, a configuration of an image forming apparatus including a transfer member, an intermediate transfer body, or a conveying belt that mounts a cartridge in a direction orthogonal to a conveyance direction has been proposed. In such a case, upon mounting the cartridge in the apparatus main body, when there is a friction between the intermediate transfer body and a photosensitive drum provided in the cartridge, a condition of a surface of the photosensitive drum or a condition of a surface of the intermediate transfer body changes, becoming a cause of image degradation.

In response to the above issue and as a method of preventing friction from occurring, a technique is known in which a cartridge support member inside an apparatus main body is moved by being interlocked with the opening and closing of a lateral cover of an image forming apparatus and in which a process cartridge is moved and lifted/lowered between an image forming position and a detaching position (Japanese Patent Laid-Open No. 8-220824).

In the configuration in which the process cartridge is moved and lifted up inside the apparatus main body so as to position the process cartridge at the image forming position, an urging member is used to support the process cartridge and to abut a photosensitive drum against an intermediate transfer body at an appropriate contact pressure. Accordingly, when abutting the photosensitive drum against the intermediate transfer body, the photosensitive drum may be rubbed against the intermediate transfer body and there may be an impact on the photosensitive drum or the intermediate transfer body; as a result, disadvantageously, a surface condition of at least either one of the photosensitive drum and the intermediate transfer body may be changed, becoming a cause of image degradation. Accordingly, a configuration in which the friction between the photosensitive drum and the intermediate transfer body is suppressed and in which occurrence of image degradation is suppressed is in need.

SUMMARY OF THE INVENTION

An image forming apparatus according to the present application includes a cartridge having a rotatable image carrying member, and an apparatus main body from which the cartridge is capable of being detached in a longitudinal direction of the cartridge. The apparatus main body includes an opening portion into which the cartridge is inserted, a door that is capable of being positioned in an opening position that exposes the opening portion and a closed position that covers the opening portion an endless intermediate transfer body to which a toner image formed on a surface of the image carrying member is transferred by having the image carrying member come into contact with the intermediate transfer body, an urging member that biases the cartridge such that the image carrying member abuts against the intermediate transfer body, and a frame disposed downstream in a mounting direction of the cartridge. Furthermore, while being positioned such that a first end side of the cartridge is in contact with a positioning portion of the frame, the cartridge that has been inserted when the door is in the open position is disposed under the intermediate transfer body such that a distance to a surface of the intermediate transfer body is greater on a second end side than on the first end side, and by moving the door to the closed position, the cartridge is pivoted about the positioning portion serving as a pivotal center with urging force of the urging member and the image carrying member is made to come into contact with the intermediate transfer body.

An image forming apparatus according to the present application includes a cartridge having a rotatable image carrying member, and an apparatus main body from which the cartridge is capable of being detached in a longitudinal direction of the cartridge. The apparatus main body includes an opening portion into which the cartridge is inserted, a door that is capable of being positioned in an opening position that exposes the opening portion and a closed position that covers the opening portion, an endless intermediate transfer body to which a toner image formed on a surface of the image carrying member is transferred by having the image carrying member come into contact with the intermediate transfer body, an urging member that biases the cartridge such that the image carrying member abuts against the intermediate transfer body, and a guide rail that supports the cartridge and that is capable of pivoting with respect to the apparatus main body. Furthermore, the cartridge that has been inserted when the door is in the open position is disposed under the intermediate transfer body such that a distance to a surface of the intermediate transfer body opposing the cartridge is greater on a second end side than on a first end side, and by moving the door to the closed position from the open position, the cartridge is pivoted with urging force of the urging member and the image carrying member is abutted against the intermediate transfer body.

Further features of the present invention will become apparent from the following description of exemplary embodiments with reference to the attached drawings.

DESCRIPTION OF THE EMBODIMENTS

First Exemplary Embodiment

Figure 1:
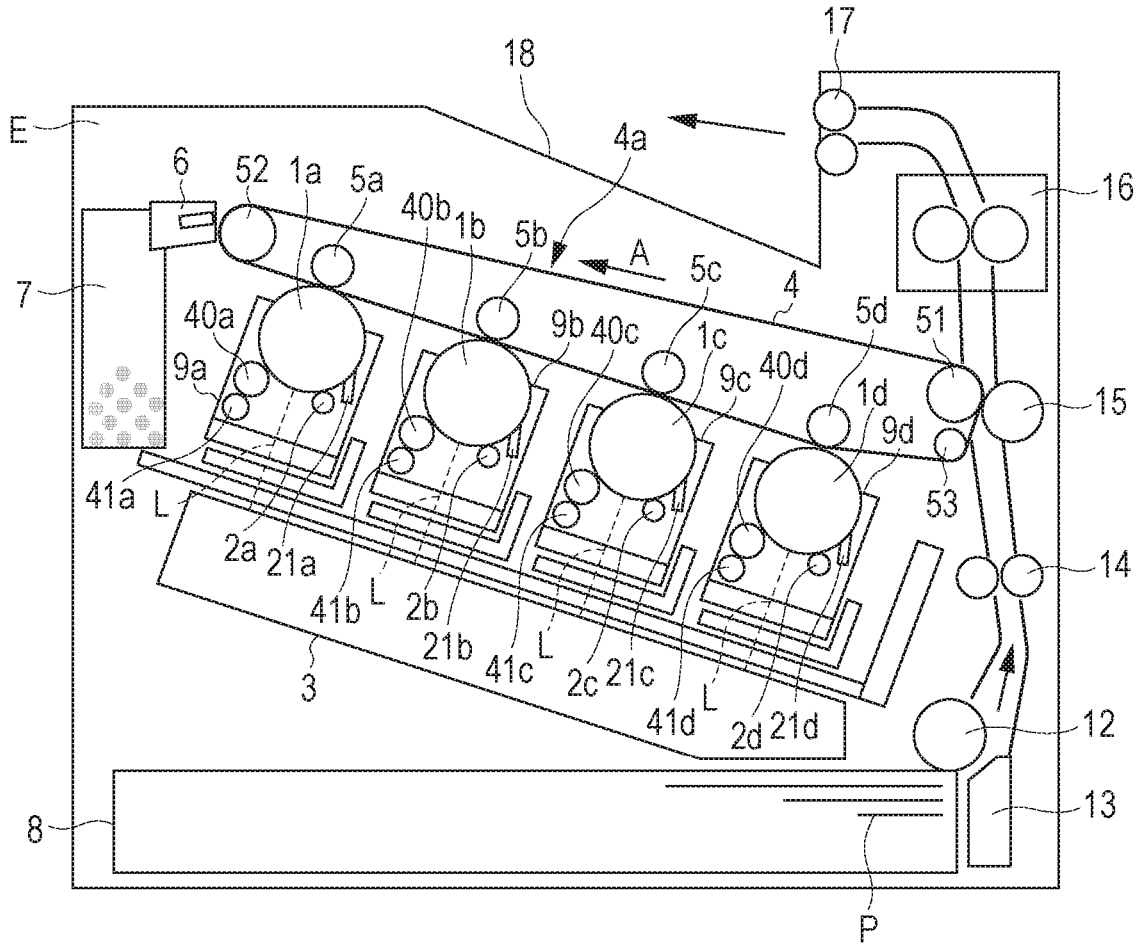
FIG. 1 is a schematic cross-sectional view of an image forming apparatus according to a first exemplary embodiment.

Hereinafter, a first exemplary embodiment of the present disclosure will be described with reference to FIGS. 1 to 4E. FIG. 1 is a schematic cross-sectional view illustrating a configuration of an image forming apparatus according to the first exemplary embodiment. Note that in the present exemplary embodiment, a color laser beam printer is exemplified as an example of the image forming apparatus.

Cartridges 9 (9*a* to 9*d*) including four rotatable photosensitive drums 1 (1*a* to 1*d*) that serve as image carrying members and that correspond to the four colors, namely, yellow, magenta, cyan, and black are mounted at a middle portion of the apparatus main body E. The cartridges 9*a* to 9*d* are disposed below an endless intermediate transfer belt 4, which is used as an intermediate transfer body, so as to be arranged along a belt surface 4*a* of the intermediate transfer belt 4. The intermediate transfer belt 4 is stretched by support rollers 51 to 53 and is rotated and driven in an arrow A direction. The intermediate transfer belt 4 is positioned above the photosensitive drums 1*a* to 1*d* and abuts against the belt surface 4*a* on an underside of the intermediate transfer belt 4 and peripheral surfaces of the photosensitive drums 1*a* to 1*d*.

The image forming apparatus of the present exemplary embodiment primarily transfers toner images of different colors formed on surfaces of the photosensitive drums 1*a* to 1*d* onto the intermediate transfer belt 4 in a sequential manner so as to superimpose the images. Subsequently, the image forming apparatus secondarily transfers a synthetic toner image on the intermediate transfer belt 4 onto a transfer sheet P serving as a recording material so as to obtain an output image.

An image forming operation of the image forming apparatus will be described next.

When a controller (not shown) transmits a print signal and the apparatus is driven, preceding the formation of the latent images, surfaces of the photosensitive drums 1*a* to 1*d* are charged in a uniform manner with charge rollers 2 (2*a* to 2*d*) to which a voltage has been applied. Subsequently, laser beams L emitted by a laser scanner 3 serving as an exposure device irradiate the surfaces of the photosensitive drums 1*a* to 1*d* such that electrostatic latent images of various colors are formed. Toner is applied onto the electrostatic latent images formed on the photosensitive drums 1*a* to 1*d* with toner applying rollers 41 (41*a* to 41*d*) and developing rollers 40 (40*a* to 40*d*) such that toner images are formed on the surface of the photosensitive drums 1*a* to 1*d*.

Subsequently, a transfer voltage is applied to primary transfer rollers 5*a* to 5*d* disposed facing the photosensitive drums 1*a* to 1*d* with the intermediate transfer belt 4 in between. With the above, toner images of various colors are each primarily transferred in a sequential manner onto the intermediate transfer belt 4 rotating in the arrow A direction such that a synthetic toner image is formed.

Meanwhile, the transfer sheets P stacked and accommodated in a transfer material accommodation portion 8 configured at the lower portion of the apparatus main body E are separated and fed sheet by sheet with a feed roller 12 and a separation portion 13. The transfer sheet P that has been sent out is sent to a portion between the intermediate transfer belt 4 and a secondary transfer roller 15 at a predetermined timing with a registration roller pair 14. At this moment, a secondary transfer voltage is applied to the secondary transfer roller 15 such that the synthetic toner image formed earlier on the intermediate transfer belt 4 is secondarily transferred onto the transfer sheet P.

By conveying the transfer sheet P on which the synthetic toner image has been secondarily transferred further upwards and passing the transfer sheet P through a fixing device 16 to apply heat and pressure thereto, the synthetic toner image is fixed to the transfer sheet P. Subsequently, the transfer sheet P is discharged to an output tray 18 provided external to a housing of the apparatus main body with a discharge roller pair 17.

Meanwhile, the toner remaining on the surfaces of the photosensitive drums 1*a* to 1*d* after the transfer of the toner images is removed by cleaning blades 21 (21*a* to 21*d*). Furthermore, the toner remaining on the intermediate transfer belt 4 after secondarily transferring the images onto the transfer material P is removed by a transfer belt cleaning device 6. The removed toner passes through a waste toner conveyance path (not shown) and is collected in a waste toner collecting container 7.

Note that image forming device including the photosensitive drums 1*a* to 1*d*, and the charge rollers 2*a* to 2*d*, development rollers 40*a* to 40*d*, and the toner applying rollers 41*a* to 41*d* for forming toner images on the surface of the photosensitive drums 1*a* to 1*d* is formed as cartridges 9 for the various colors formed in an integrated manner. As illustrated in FIG. 1, the four cartridges 9 are disposed so as to be aligned in an oblique manner such that the left end is high and the right end is low. The above arrangement is set in order to correspond to the arrangement of the primary transfer surface of the intermediate transfer belt 4 that is disposed in an oblique manner to reduce the size thereof in the width direction of the apparatus main body.

Figure 2A:
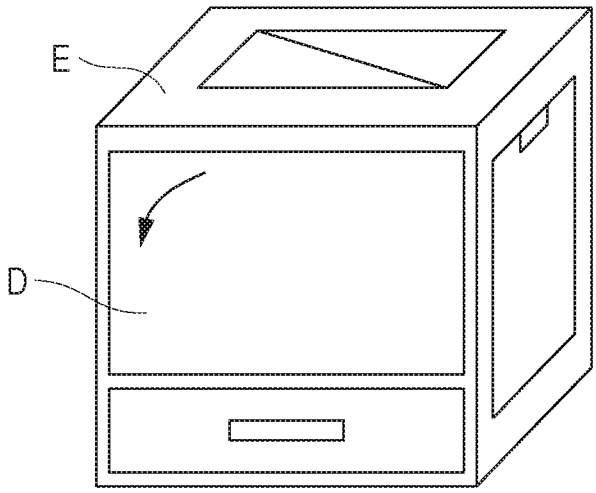
FIGS. 2A and 2B are perspective views of the image forming apparatus according to the first exemplary embodiment.
Figure 2B:
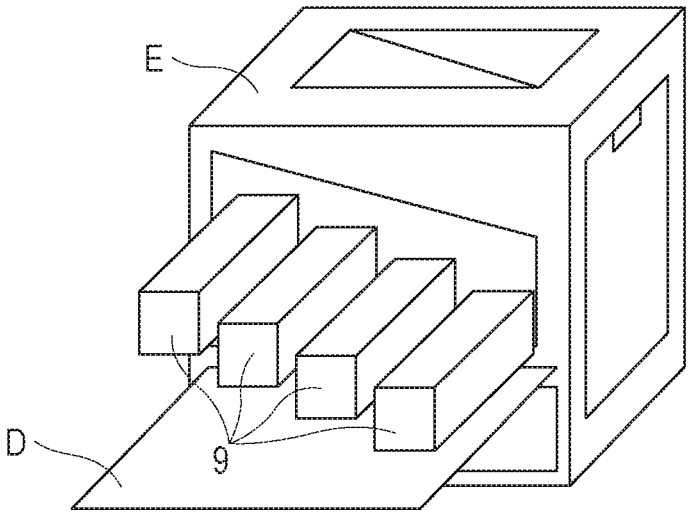

The cartridges 9 are detachable in a longitudinal direction, that is, the cartridges 9 are detachable in the axial directions of the photosensitive drums 1*a* to 1*d*, and as illustrated in FIG. 2B, when a door D is in an open position, the cartridges 9 can be inserted through an opening that has been exposed. The apparatus main body E includes the door D, and by moving the door D from a closed position in which the door D covers the opening portion (FIG. 2A) to the open position in which the opening portion is exposed (FIG. 2B), each of the cartridges 9 is detachable with respect to the apparatus main body E.

Cartridge Attaching and Detaching Mechanism

Figure 3A:
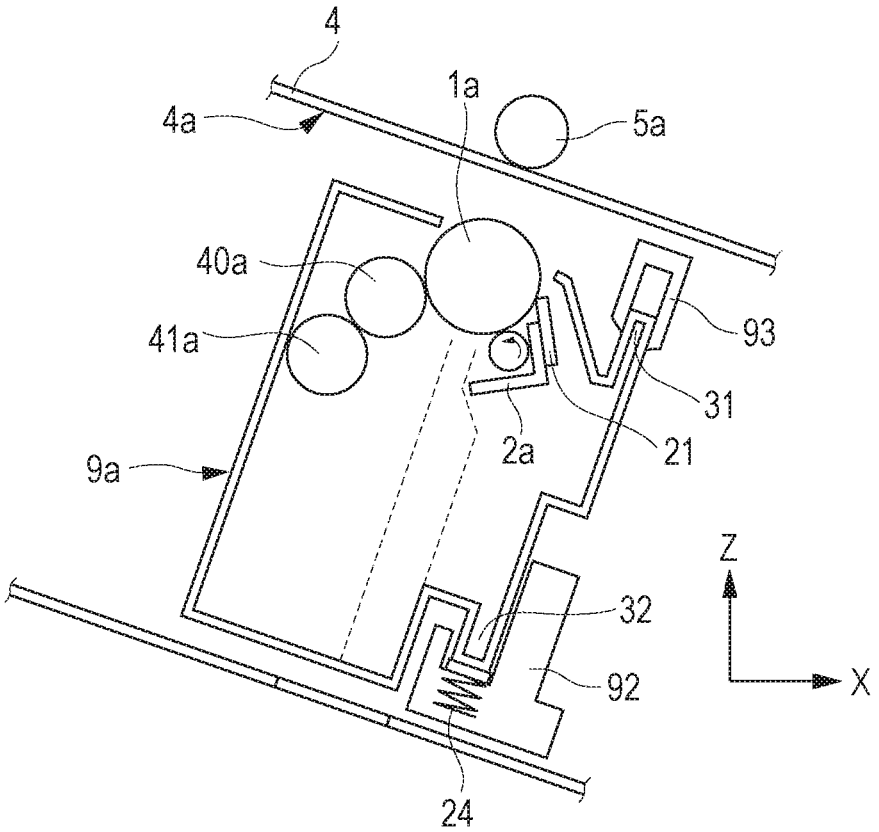
FIGS. 3A and 3B are cross-sectional views of a portion near a cartridge of the image forming apparatus according to the first exemplary embodiment.
Figure 3B:
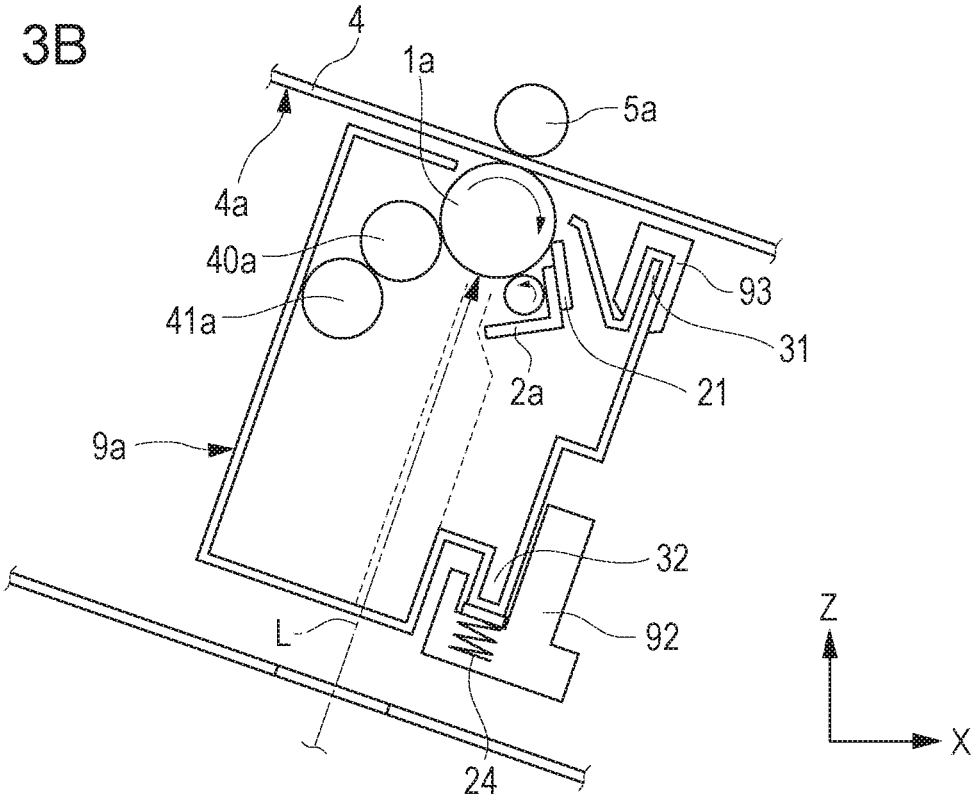

In the present and following exemplary examples, one of the cartridges 9 will be used as an example to describe, in detail, the attaching and detaching mechanism of the cartridges 9. FIGS. 3A and 3B are schematic cross-sectional views illustrating a configuration of the cartridge 9*a* and the apparatus main body E in the vicinity of the cartridge 9*a*. FIG. 3A is a cross-sectional view in which the door D is at the open position, and FIG. 3B is a cross-sectional view in which the door D is at the closed position. Furthermore, FIGS. 4A to 4E illustrate traces of one of the cartridges 9 when the cartridge 9 is in the course of being mounted, and are explanatory drawings of the schematic cross-sectional views of the apparatus main body E viewed from the side.

As illustrated in FIGS. 3A and 3*b*, in the cartridge 9*a*, the photosensitive drum 1*a* is disposed so as to be exposed at the upper portion of the cartridge 9*a*. The cartridge 9*a* includes an upper engagement portion 31 and a lower engagement portion 32 that protrudes upwards and downwards in the cartridge 9*a*. Meanwhile, in the apparatus main body E, a lower guide rail 92 that guides the lower engagement portion 32, and an upper guide rail 93 that guides the upper engagement portion 31 are provided. When the cartridge 9*a* is mounted in the apparatus main body E, the upper engagement portion 31 is supported by the upper guide rail 93, and the lower engagement portion 32 is supported by the lower guide rail 92. A compression portion 22 and a compression portion 23 are provided in the lower guide rail 92 in order from the upstream side in the insertion direction K. The compression portion 22 and the compression portion 23 are each biased towards the intermediate transfer belt 4 with an urging member 24 that is capable of being contracted in a direction in which the cartridge 9*a* comes in contact with the intermediate transfer belt 4. Note that in the following description, the compression portion 22 and the urging member 24 that are provided on the upstream side in the insertion direction K, and the compression portion 23 and the urging member 24 that are on the provided downstream side in the insertion direction K will be merely referred to as an urging member.

A process of mounting one of the cartridges 9 in the apparatus main body E will be described with reference to FIGS. 4A to 4E. Note that in the following description, the upstream side of the cartridge 9 in the insertion direction K will be merely referred to as the upstream side, and the downstream side of the cartridge 9 in the insertion direction K will be merely referred to as the downstream side.

Figure 4A:
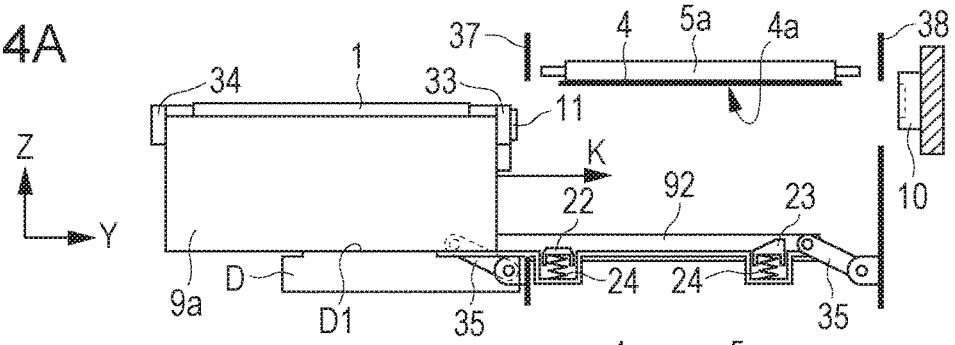
FIGS. 4A to 4E are schematic diagrams for describing an attaching and detaching trace of the cartridge of the image forming apparatus according to the first exemplary embodiment.

As illustrated in FIG. 4A, first, the door D of the apparatus main body E is set at the open position. In the above state, the cartridge 9*a* is placed on the door D so that the lower engagement portion 32 of the cartridge 9*a* engages with a door guide D1. The door guide D1 is formed in a rail-shape that is in communication with the lower guide rail 92 in the mounting direction so as to enable the cartridge 9*a* to be slid and mounted in the cartridge insertion direction K.

Figure 4B:
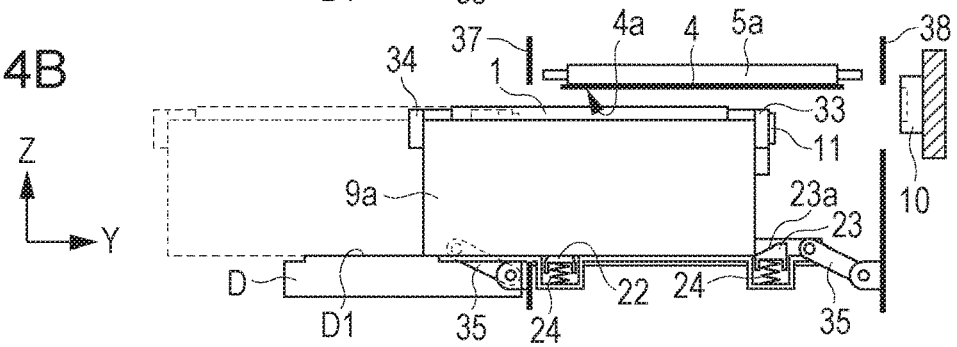

Subsequently, as illustrated in FIG. 4B, the cartridge 9*a* is slid and inserted in the arrow K direction in the drawing parallel to the axial direction of the transfer roller 5*a*. In the above, the cartridge 9*a* moves over the compression portion 22 provided on the upstream side of the lower guide rail 92 and is slid and inserted in a parallel manner until coming into contact with the compression portion 23 disposed on the downstream side.

Figure 4C:
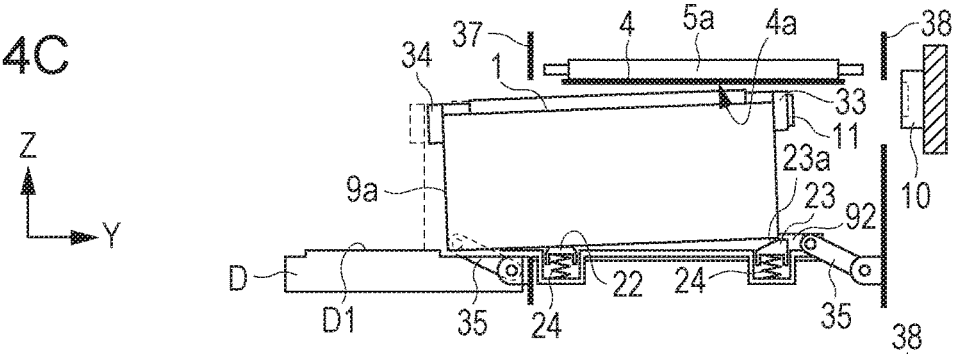

When inserted further, as illustrated in FIG. 4C, a front end lower portion of the cartridge 9*a* comes in contact with an inclination portion 23*a* of the compression portion 23 and moves along the inclination portion 23*a* of the compression portion 23 so as to move onto the inclination portion 23*a* of the compression portion 23; accordingly, the front end of the cartridge 9*a* moves obliquely upwards.

Figure 4D:
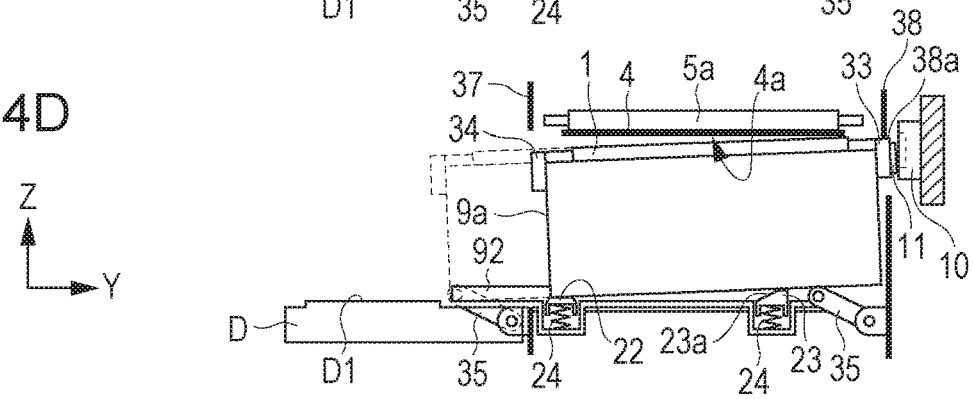

Furthermore, as illustrated in FIG. 4D, the cartridge 9*a* is inserted in the obliquely upwards direction until a flange portion 33 provided in the cartridge 9*a* and downstream in the cartridge insertion direction K bumps against a side plate 38 (a frame) downstream in the apparatus main body E. In order to rotatably support the photosensitive drum 1*a*, the cartridge 9*a* is provided with the flange portion 33 on the downstream side and a flange portion 34 on the upstream side. Positioning is performed by abutting the flange portion 33 on the downstream side against a positioning portion 38*a* of the side plate 38. Note that when the flange portion 33 abuts against the positioning portion 38*a*, the urging member 24 is contracted while urging the compression portion 23 upwards such that compression force for positioning the flange portion 33 to the positioning portion 38*a* is applied. At this moment, the axial direction of the photosensitive drum 1*a* of the cartridge 9*a* is not parallel to the belt surface 4*a* of the intermediate transfer belt 4 against which the photosensitive drum 1*a* is abutted. In other words, when the door D is at the open position, the inserted cartridge 9*a* is disposed under the intermediate transfer belt 4 such that the distance between the opposing belt surface 4*a* (the front surface) of the intermediate transfer belt 4 is larger on the upstream side (the other end side) with respect to that on the downstream side (one end side) in the cartridge insertion direction K.

Figure 4E:
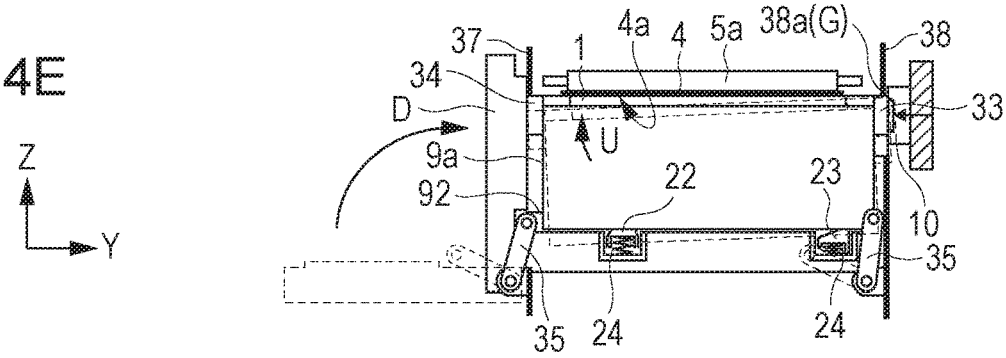

Furthermore, as illustrated in FIG. 4E, the door D is closed at the end. The door D is configured to move in an interlocked manner with the lower guide rail 92 through a link arm 35. From the state in which the lower guide rail 92 is inclined downwards when the door D is in the open position, by closing the door D to the closed position, the lower guide rail 92 performs lifting and lowering motion by interlocking with the opening and closing motion of the door D. Specifically, when the door D is closed, the interlocked link arm 35 is pivoted, and the lower guide rail 92 is lifted by the link arm 35. As described above, by moving the door D to the closed position, the photosensitive drum 1*a* is brought into contact with the intermediate transfer belt 4 with the urging force of the urging member, sequentially, from the downstream side (the one end side) to the upstream side (the other end side) in the insertion direction K.

More specifically, the lower guide plate 92 is lifted after the flange portion 33 provided on the downstream side (the one end side) of the cartridge 9*a* in the cartridge insertion direction K is abutted against the positioning portion 38*a* of the side plate 38 so as to be in a positioned state. Accordingly, the one end side of the cartridge 9*a* is does not move upwards. On the other hand, positioning is not performed on the other end side of the cartridge 9*a*. Accordingly, when the lower guide rail 92 is lifted, while the positioning portion 38*a*, which is in contact with the flange portion 33, serves as a pivotal center G, the cartridge 9*a* rotates in an arrow U direction in the drawing about the pivotal center G such that the upstream side (the other end side) of the cartridge 9*a* is lifted. As a result, when the lower guide rail 92 interlocked with the motion of the closing door D is lifted, the cartridge 9*a* pivots about the positioning portion 38*a* serving as the pivotal center such that the one end side to the other end side of the photosensitive drum 1*a* in the insertion direction K comes sequentially in contact with the intermediate transfer belt 4. Furthermore, ultimately, the flange portion 34 provided in the cartridge 9*a* on the upstream side of the cartridge 9*a* is abutted against a side plate 37 that forms the opening portion of the apparatus main body E such that positioning is performed.

As described above, the toner image formed on the photosensitive drum 1*a* becomes capable of being transferred to the intermediate transfer belt 4 by positioning the cartridge 9*a* in the apparatus main body E and by urging and abutting the photosensitive drum 1*a* against the intermediate transfer belt 4 at a predetermined pressure with the urging members 24 through the compression portions 22 and 23.

Note that the cartridges 9 each include a drive transmitted member 11 on an end on the downstream side. On the other hand, drive transmitting members 10 each for transmitting a drive to the corresponding cartridge 9 that has been provided in the apparatus main body E is provided in the apparatus main body E. The drive transmitting member 10 is provided in the apparatus main body E on the downstream side of the cartridge insertion direction K. The drive transmitted member 11 and the drive transmitting member 10 each have a polygonal, recessed and protruded shape. Driving power can be transmitted by meshing the drive transmitted member 11 and the drive transmitting member 10 to each other. As illustrated in FIG. 4A, the cartridge 9*a* is inserted into the apparatus main body E so that the drive transmitted member 11 is positioned on the downstream side of the apparatus main body E in the cartridge insertion direction K. Subsequently, as illustrated in FIG. 4E, by closing the door D, the drive transmitting member 10 can be moved upstream in the cartridge insertion direction K with a link mechanism (not shown) that interlocks with the opening and closing motion of the door D. Specifically, when the door D is at the open position, the drive transmitting member 10 retracts downstream in the cartridge insertion direction K. With the above, the drive transmitting member 10 and the drive transmitted member 11 do not connect to each other when the insertion of the cartridge 9*a* towards the downstream side in the cartridge insertion direction K has been completed. Conversely, when the door D is closed to the closed position, the drive transmitting member 10 protrudes upstream in the cartridge insertion direction K. With the above, the drive transmitting member 10 and the drive transmitted member 11 are connected to each other such that the drive is allowed to be transmitted.

As described above, by closing the door D after inserting the cartridge 9*a* in the apparatus main body E, the photosensitive drum 1*a* can be abutted against the intermediate transfer belt 4, and the drive transmitting member 10 and the drive transmitted member 11 can be connected to each other in a driving manner; accordingly, image formation can be performed. Note that the operation of taking out the cartridge 9*a* is performed through a reversed process with respect to the process performed in mounting the cartridge 9*a* described above.

Advantageous Effects

In the above configuration, insertion can be performed while there is a gap between the photosensitive drum 1*a* of the cartridge 9*a* and the belt surface 4*a* of the intermediate transfer belt 4. With the above configuration, friction between the intermediate transfer belt 4 and the photosensitive drum 1*a* provided in the cartridge 9*a* can be prevented in a better manner.

Furthermore, the cartridge 9*a* is pivoted about the positioning portion 38*a* serving as the pivotal center G to have the photosensitive drum 1*a* come into contact with the intermediate transfer belt 4. In other words, in the above configuration, positioning is performed by having the flange portion 33 of the cartridge 9*a* come into contact with the positioning portion 38*a*, and while the movement of the cartridge 9*a* is restricted to a movement along the lower guide plate 92, the photosensitive drum 1*a* is abutted against the intermediate transfer belt 4 with the urging force of the urging members 24. As a result, by having the downstream side of the cartridge 9*a* be restricted such that the downstream side of the cartridge 9*a* is a pivotal center and, furthermore, by the urging force of the urging members 24, the friction created between the intermediate transfer belt 4 and the photosensitive drum 1*a* when the intermediate transfer belt 4 and the photosensitive drum 1*a* are pressed against each other is suppressed and the occurrence of image degradation can be suppressed.

Second Exemplary Embodiment

Figure 5A:
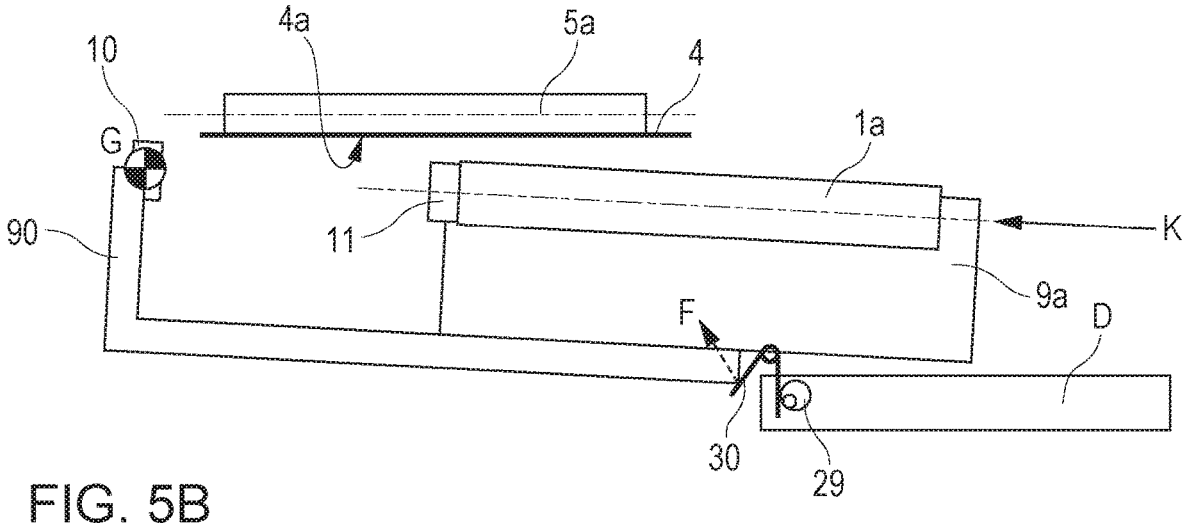
FIGS. 5A to 5C are schematic diagrams for describing an attaching and detaching trace of a cartridge of an image forming apparatus according to a second exemplary embodiment.
Figure 5B:
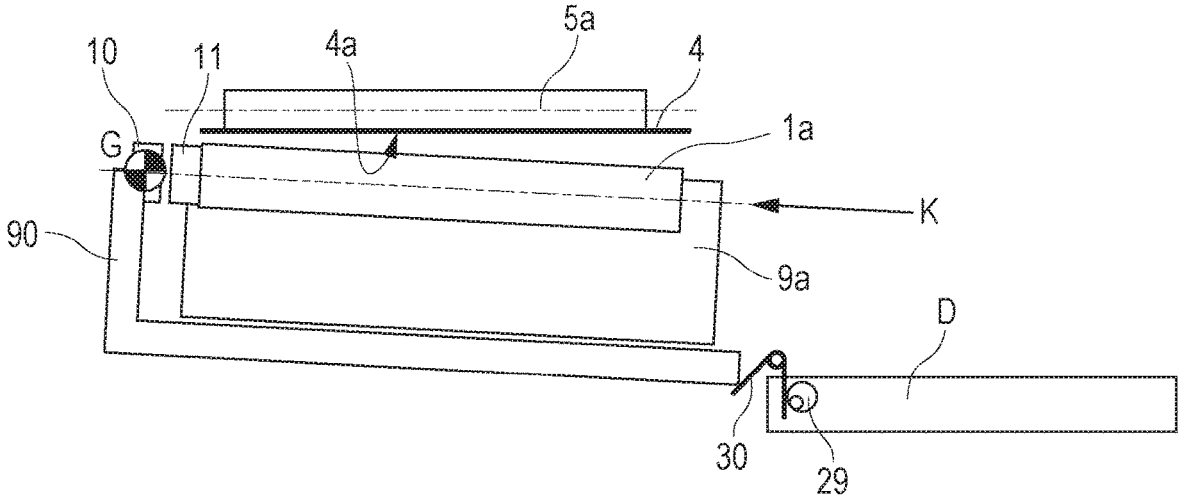
Figure 5C:
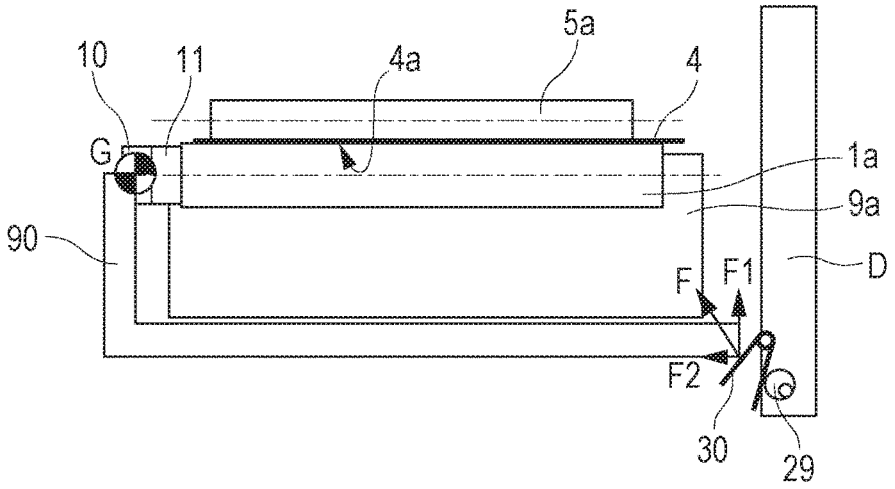

Hereinafter, a second exemplary embodiment of the present disclosure will be described with reference to FIGS. 5A to 5C. FIGS. 5A to 5C are schematic diagrams, viewed from the side, illustrating the attaching and detaching trace when mounting the cartridge 9*a* in the apparatus main body E. In the present exemplary embodiment, description of the attaching and detaching mechanism of the cartridge 9*a* will be given mainly. Components that are similar to those of the first exemplary embodiment will be attached with the same reference numerals and description thereof will be omitted. Description will be given mainly on the different points.

In the first exemplary embodiment, the photosensitive drum 1*a* is abutted against the intermediate transfer belt 4 by lifting the lower guide rail 92 that moves by being interlocked with the door D through the link arm 35. However, not limited to the above, in the present exemplary embodiment, the photosensitive drum 1*a* is abutted against the intermediate transfer belt 4 by pivoting a guide rail 90.

As illustrated in FIG. 5A, in the present exemplary embodiment, by setting the door D of the apparatus main body E to an open position, a cam 29 that is pivoted by being interlocked with the pivoting of the door D is positioned at a position that weakens the urging force of an elastic member 30. With the above, an urging force F from the elastic member 30 that biases the guide rail 90 about the pivotal center G towards the intermediate transfer belt 4 side is weakened such that the guide rail 90 is inclined towards the lower right.

In the above state, an engagement portion (not shown) provided in the cartridge 9*a* is engaged with the guide rail 90 and the cartridge 9*a* is inserted along the guide rail 90. With the above, the photosensitive drum 1*a* configured in the cartridge 9*a* can be inserted to the downstream side in the cartridge insertion direction K without any friction with the intermediate transfer belt 4.

Subsequently, as illustrated in FIG. 5B, when the cartridge 9*a* is inserted to the downstream side in the cartridge insertion direction K, the drive transmitted member 11 provided in the cartridge 9*a* engages with the drive transmitting member 10 provided in the image forming apparatus main body E. In the present exemplary embodiment, the drive transmitting member 10 is capable of swinging according to the pivoting of the guide rail 90. Accordingly, even when the guide rail 90 is inclined towards the lower right, when the cartridge 9*a* is inserted to the far side of the main body, the drive transmitted member 11 fits with the drive transmitting member 10. Note that in a state in which the cartridge 9*a* is inserted to the downstream side in the insertion direction K, the axial direction of the photosensitive drum 1*a* of the cartridge 9*a* is not parallel to the belt surface 4*a* of the intermediate transfer belt 4 against which the photosensitive drum 1*a* is abutted. In other words, when the door D is at the open position, the inserted cartridge 9*a* is disposed under the intermediate transfer belt 4 such that the distance between the opposing belt surface 4*a* (the front surface) of the intermediate transfer belt 4 is larger on the upstream side (the other end side) with respect to that on the downstream side (one end side) in the cartridge insertion direction K.

Subsequently, as illustrated in FIG. 5C, by moving the door D to the closed position from the open position, the cam 29 interlocked with the door D rotates the guide rail 90 about the pivotal center G through the elastic member 30 and presses the cartridge 9*a* against the intermediate transfer belt 4. In other words, by moving the door D to the closed position, the photosensitive drum 1*a* is brought into contact with the intermediate transfer belt 4 with the urging force of the urging member, sequentially, from the downstream side (the one end side) to the upstream side (the other end side) in the insertion direction K. Note that with the force F exerted from the elastic member 30, components of force F1 and F2 are exerted to the guide rail 90. Since the component of force F2 is a force that is parallel to the surface of the guide rail 90 on which the cartridge is placed, the component of force F2 does not affect the rotation of the guide rail 90. On the other hand, the component of force F1 rotates and biases the guide rail 90 such that the cartridge 9*a* presses and abuts against the intermediate transfer belt 4. As a result, when the cartridge 9*a* is accommodated inside the apparatus main body E, the cartridge 9*a* is reliably fixed in the vertical and horizontal direction.

Furthermore, in the present exemplary embodiment, the drive transmitting member 10 and the drive transmitted member 11 can be engaged to each other by enabling the drive transmitting member 10 to swing in accordance with the pivoting of the guide rail 90, in other words, the drive transmitting member 10 and the drive transmitted member 11 can be engaged to each other by inserting the drive transmitted member 11 into the drive transmitting member 10 in the insertion direction of the cartridge 9*a*. However, the present disclosure is not limited to the above.

For example, the center of the swing of the drive transmitting member 10 and the pivotal center G of the guide rail 90 may be positioned so as to superimpose each other in the axial direction of the primary transfer roller 5*a*, that is, the longitudinal direction of the transfer member. The above is preferable since the drive transmitting member 10 and the drive transmitted member 11 can be engaged with each other by the rotating motion of the guide rail 90 and the pressing motion of the cartridge 9*a* against the intermediate transfer belt 4.

By disposing the drive transmitting member 10 and the drive transmitted member 11 in the above manner, damage and deformation of the guide rail 90 upon rotation can be suppressed and occurrence of periodic image defect when forming an image can be reduced.

Advantageous Effects

In the above configuration, insertion can be performed while there is a gap between the photosensitive drum 1*a* of the cartridge 9*a* and the belt surface 4*a* of the intermediate transfer belt 4. With the above configuration, friction between the intermediate transfer belt 4 and the photosensitive drum 1*a* provided in the cartridge 9*a* can be prevented in a better manner.

Furthermore, the cartridge 9*a* is pivoted about the pivotal center G of the guide rail 90 to have the photosensitive drum 1*a* come into contact with the intermediate transfer belt 4. In other words, in the above configuration, while the movement of the guide rail 90 is restricted to a pivoting motion about the pivotal center G, the photosensitive drum 1*a* is abutted against the intermediate transfer belt 4 with the urging force of the elastic member 30. As a result, by restricting the rotation to be performed only by the movable portion provided downstream of the cartridge 9*a* and, furthermore, by the urging force of the elastic member 30, the friction created between the intermediate transfer belt 4 and the photosensitive drum 1*a* when the intermediate transfer belt 4 and the photosensitive drum 1*a* are pressed against each other is suppressed and the occurrence of image degradation can be suppressed.

Third Exemplary Embodiment

Figure 6A:
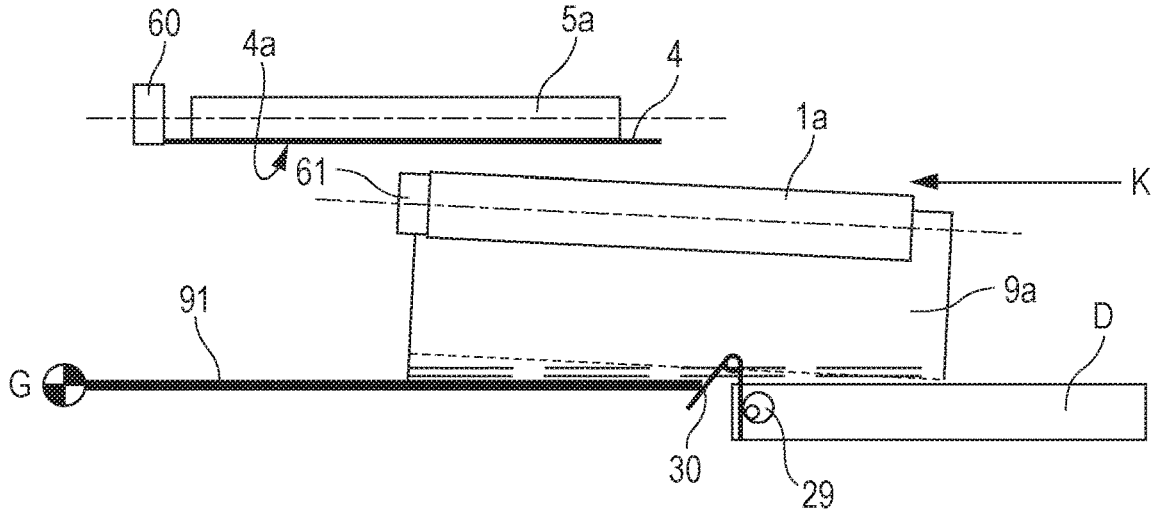
FIGS. 6A to 6C are schematic diagrams for describing an attaching and detaching trace of a cartridge of an image forming apparatus according to a third exemplary embodiment.
Figure 6B:
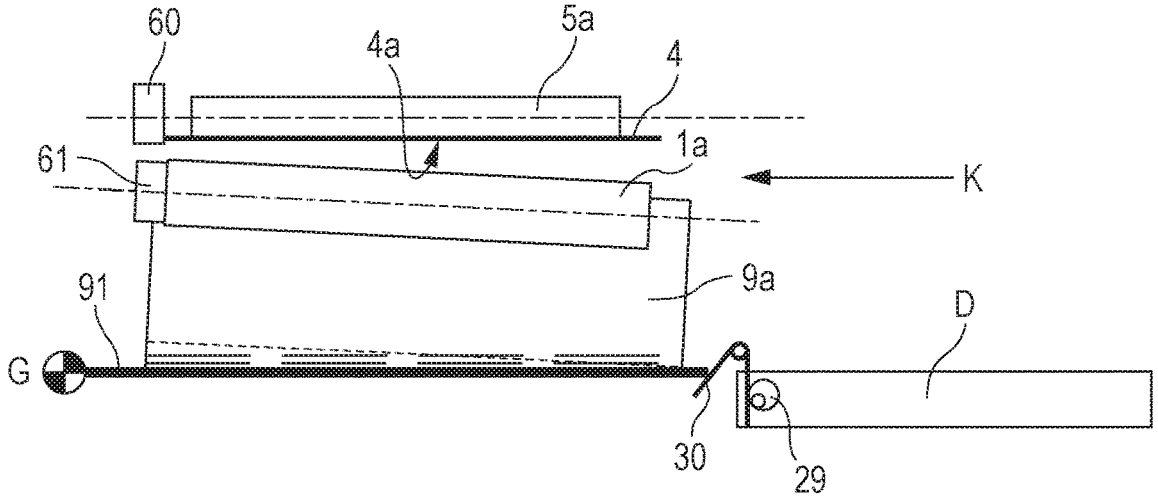

Hereinafter, a third exemplary embodiment of the present disclosure will be described with reference to FIGS. 6A to 6C. In the present exemplary embodiment, a shape of a cartridge 9*a* and an attaching and detaching mechanism of the cartridge 9*a* will be described. Components that are similar to those of the first exemplary embodiment will be attached with the same reference numerals and description thereof will be omitted. Description will be given mainly on the different points.

In the first exemplary embodiment, the photosensitive drum 1*a* is abutted against the intermediate transfer belt 4 by lifting the lower guide rail 92 that moves by being interlocked with the door D through the link arm 35. Conversely, in the third exemplary embodiment, by moving the door D of the apparatus main body E to the closed position from the open position, a guide rail 91 is inclined from a state in which the guide rail 91 is parallel to the axial direction of the primary transfer roller 5*a*, that is, parallel to the longitudinal direction of the transfer member, to a non-parallel state.

The attaching and detaching mechanism of the cartridge 9*a* is similar to that of the second exemplary embodiment. As illustrated in FIG. 6A, an engagement portion (not shown) provided in the cartridge 9*a* is engaged with the guide rail 91 and the cartridge 9*a* is inserted along the guide rail 91. With the above, as illustrated in FIG. 6B, the cartridge 9*a* is inserted to the downstream side in the cartridge insertion direction K without any friction between the photosensitive drum 1*a* configured in the cartridge 9*a* and the intermediate transfer belt 4. Note that in a state in which the cartridge 9*a* is inserted to the downstream side in the insertion direction K, the axial direction of the photosensitive drum 1*a* of the cartridge 9*a* is not parallel to the belt surface 4*a* of the intermediate transfer belt 4 against which the photosensitive drum 1*a* is abutted. In other words, when the door D is at the open position, the inserted cartridge 9*a* is disposed under the intermediate transfer belt 4 such that the distance between the opposing belt surface 4*a* (the front surface) of the intermediate transfer belt 4 is larger on the upstream side (the other end side) with respect to that on the downstream side (one end side) in the cartridge insertion direction K.

Figure 6C:
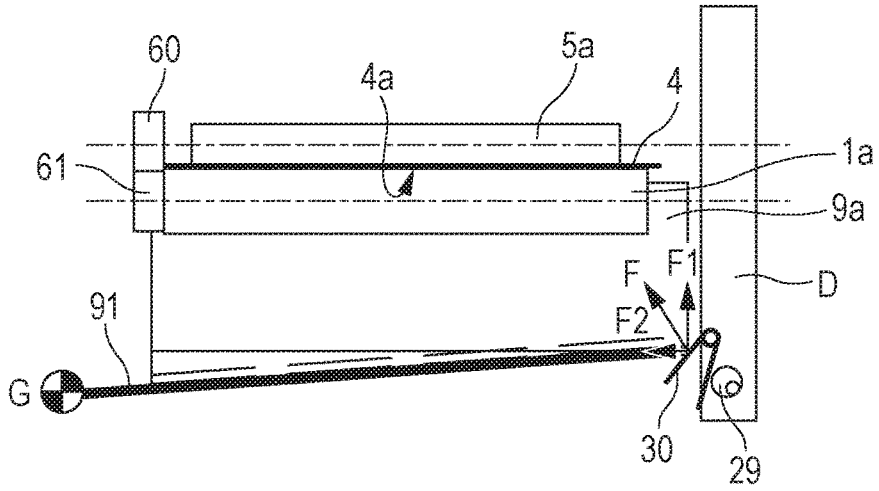

Subsequently, as illustrated in FIG. 6C, by moving the door D to the closed position from the open position, the cam 29 interlocked with the door D rotates the guide rail 91 about the pivotal center G through the elastic member 30 and presses the cartridge 9*a* against the intermediate transfer belt 4. In other words, by moving the door D to the closed position, the photosensitive drum 1*a* is brought into contact with the intermediate transfer belt 4 with the urging force of the urging member, sequentially, from the downstream side (the one end side) to the upstream side (the other end side) in the insertion direction K. Note that with the force F exerted from the elastic member 30, components of force F1 and F2 are exerted to the guide rail 90. Since the component of force F2 is a force that is parallel to the surface of the guide rail 91 on which the cartridge is placed, the component of force F2 does not affect the rotation of the guide rail 91. On the other hand, the component of force F1 rotates and biases the guide rail 91 such that the cartridge 9*a* presses and abuts against the intermediate transfer belt 4.

In the present exemplary embodiment, a drive transmitted member 61 provided in the cartridge 9*a* and a drive transmitting member 60, which transmits a drive to the cartridge 9*a*, provided in the apparatus main body E engage with each other with tooth forms provided in each of the outer peripheral portions so that a drive is transmitted. With the pivoting of the guide rail 91, the drive transmitted member 61 provided in the cartridge 9*a* and a drive transmitting member 60, which transmits a drive to the cartridge 9*a*, provided in the apparatus main body E engage with each other. As a result, when the cartridge 9*a* is accommodated inside the apparatus main body E, the cartridge 9*a* is reliably fixed in the vertical and horizontal direction, and the drive transmitting member 60 and the drive transmitted member 61 engage with each other such that driving power can be transmitted.

Furthermore, in the present exemplary embodiment, the guide rail 91, that is, the surface on which the cartridge 9*a* is placed, is formed straight, and the pivotal center G of the guide rail 91 is positioned on a straight line that overlaps the direction in which the guide rail 91 extends. In other words, the cartridge 9*a* used in the present exemplary embodiment has a shape in which length (height) in the direction in which the cartridge 9*a* and the intermediate transfer belt 4 are aligned becomes longer (larger) from the upstream side to the downstream side in the cartridge insertion direction K. That is, in a state in which the cartridge 9*a* is inserted to the downstream side in the insertion direction K, the axial direction of the photosensitive drum 1*a* of the cartridge 9*a* is not parallel to the belt surface 4*a* of the intermediate transfer belt 4 against which the photosensitive drum 1*a* is abutted. In other words, in a state in which the door D is in the open state, the inserted cartridge 9*a* is disposed such that the distance between the opposing belt surface 4*a* (the front surface) of the intermediate transfer belt 4 is larger on the upstream side (the other end side) with respect to that on the downstream side (one end side) in the cartridge insertion direction K. As a result, in the cartridge 9*a* according to the present exemplary embodiment, a cross-section of the cartridge 9*a* that is orthogonal to the pivotal axis of the guide rail 91 has a substantially trapezoidal shape.

Advantageous Effects

In the above configuration, insertion can be performed while there is a gap between the photosensitive drum 1*a* of the cartridge 9*a* and the belt surface 4*a* of the intermediate transfer belt 4. With the above configuration, friction between the intermediate transfer belt 4 and the photosensitive drum 1*a* provided in the cartridge 9*a* can be prevented in a better manner.

Furthermore, the cartridge 9*a* is pivoted about the pivotal center G of the guide rail 91 to have the photosensitive drum 1*a* come into contact with the intermediate transfer belt 4. In other words, in the above configuration, while the movement of the guide rail 91 is restricted to a pivoting motion about the pivotal center G, the photosensitive drum 1*a* is abutted against the intermediate transfer belt 4 with the urging force of the elastic member 30. As a result, by restricting the rotation to be performed only by the movable portion provided downstream of the cartridge 9*a* and, furthermore, by the urging force of the elastic member 30, the friction created between the intermediate transfer belt 4 and the photosensitive drum 1*a* when the intermediate transfer belt 4 and the photosensitive drum 1*a* are pressed against each other is suppressed and the occurrence of image degradation can be suppressed.

Additionally, the guide rail 91 is pivoted by setting the door D to the closed position. With such a configuration, the moving amount on the downstream side in the insertion direction K of the cartridge 9 can be reduced compared to that on the upstream side. As a result, the dead space that is needed to prevent friction between the photosensitive drum 1*a* and the intermediate transfer belt 4 can be made smaller and the volume of the cartridge can be increased to increase the toner amount and the waste toner amount. In other words, while achieving size reduction of the image forming apparatus itself, the image forming apparatus will be capable of mounting a large volume replacement process unit.

As described above, the preferred exemplary embodiments of the present disclosure have been illustrated and described; however, the technical scope of the disclosure is not limited to the exemplary embodiments described above and is determined based on the Claims. Naturally, any person with ordinary skill in the art to which the disclosure pertains is capable of making various modification without departing from the gist of the present disclosure claimed in the Claims. The above modified techniques belong to the technical scope of the disclosure stated in the Claims.

For example, in the first to third exemplary embodiments, the transfer surfaces of the intermediate transfer belt 4 and the transfer rollers 5*a* to 5*d* may be movable to positions spaced away from the photosensitive drums 1*a* to 1*d*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-152146, filed Jul. 31, 2015, which is hereby incorporated by reference herein in its entirety.

What is claimed is:

1. An image forming apparatus comprising:

a cartridge including an image carrying member configured to rotate about a rotational axis and to carry a toner image on a surface of the image carrying member; and an apparatus main body to which the cartridge is mountable in a mounting direction along a direction of the rotational axis, wherein the apparatus main body includes an opening portion through which the cartridge passes when the cartridge is mounted to the apparatus main body, a door movable between an opening position where the opening portion is opened and a closed position where the opening portion is closed, and an intermediate transfer body having a transferred surface to which the toner image carried on the surface of the image carrying member is transferred in a state that the image carrying member contacts with the intermediate transfer body, the intermediate transfer body being disposed over the cartridge attached to the apparatus main body, wherein the apparatus main body is configured so that the cartridge is moved from a first position to a second position by interlocking with a movement of the door from the opening position to the closed position, the first position of the cartridge being a position where the rotational axis of the image carrying member is inclined with respect to the transferred surface of the intermediate transfer body so that a first distance, in a vertical direction, between the rotational axis of the image carrying member and the transferred surface of the intermediate transfer body on an upstream side of the cartridge in the mounting direction is larger than a second distance, in the vertical direction, between the rotational axis of the image carrying member and the transferred surface of the intermediate transfer body on a downstream side of the cartridge in the mounting direction, the second position of the cartridge being a position where the image carrying member on the upstream and downstream sides of the cartridge contacts with the transferred surface of the intermediate transfer body.

2. The image forming apparatus according to claim 1, wherein the apparatus main body includes a guide rail unit extending in the mounting direction and on which the cartridge is mountable and configured to guide the cartridge while the cartridge is being mounted to the apparatus main body, and to support the cartridge to incline the rotational axis of the image bearing member with respect to the transferred surface of the intermediate transfer body so that the first distance is larger than the second distance when the cartridge is positioned in the first position, and wherein the guide rail unit is configured to move the cartridge from the first position to the second position by interlocking with the movement of the door from the opening position to the closed position.

3. The image forming apparatus according to claim 2, wherein the apparatus main body includes a frame disposed downstream of the cartridge, in the mounting direction, that has been attached to the apparatus main body, the frame including a positioning portion with which a downstream end portion of the cartridge in the mounting direction contacts so as to position the downstream end portion of the cartridge with respect to the frame in an orthogonal direction orthogonal to the rotational axis, and wherein the guide rail unit includes a guide rail and an elastic portion provided on the guide rail, wherein when the cartridge is positioned in the first position, the elastic portion urges the downstream end of the cartridge against the positioning portion of the frame by being elastically compressed between the cartridge and the guide rail, and when the cartridge is positioned in the second position, the elastic portion urges the image bearing member against the intermediate transfer body by being elastically compressed between the cartridge and the guide rail.

4. The image forming apparatus according to claim 3, wherein the elastic portion is provided on a downstream side of the guide rail unit in the mounting direction, and a surface of the elastic portion is inclined so that a distance, in the vertical direction, between the surface of the elastic portion and the intermediate transfer body becomes smaller as it goes in the mounting direction.

5. The image forming apparatus according to claim 1, wherein while the cartridge is moved from the first position to the second position, the cartridge is pivoted about a pivotal center that is a contact portion in which the downstream end of the cartridge and the positioning portion of the frame contact with each other.

6. The image forming apparatus according to claim 1, wherein the image bearing member is a photosensitive drum.

7. The image forming apparatus according to claim 1, wherein the apparatus main body includes a frame disposed downstream of the cartridge, in the mounting direction, that has been attached to the apparatus main body, the frame including a positioning portion with which a downstream end portion of the cartridge in the mounting direction contacts so as to position the downstream end portion of the cartridge with respect to the frame in an orthogonal direction orthogonal to the rotational axis, and wherein when the cartridge is positioned in the first position, the downstream end portion of the cartridge contacts with the positioning portion of the frame, and when the cartridge is positioned in the second position, the downstream end portion of the cartridge contacts with the positioning portion of the frame so as to position the downstream end portion of the cartridge with respect to the frame in the orthogonal direction.

8. An image forming apparatus comprising:

a cartridge including an image carrying member configured to rotate about a rotational axis and to carry a toner image on a surface of the image carrying member; and an apparatus main body to which the cartridge is mountable in a mounting direction along a direction of the rotational axis, wherein the apparatus main body includes an intermediate transfer body having a transferred surface to which the toner image carried on the surface of the image carrying member is transferred and disposed over the cartridge attached to the apparatus main body, and a guide rail unit extending in the mounting direction and on which the cartridge is mountable and configured to guide and support the cartridge while the cartridge is being mounted to the apparatus main body, the guide rail unit being configured to move, with the cartridge mounted thereon, between a lowering position and a lifting position, wherein when the guide rail unit is positioned in the lowering position, the guide rail unit supports the cartridge to incline the rotational axis of the image bearing member with respect to the transferred surface of the intermediate transfer body so that a distance, in a vertical direction, between the rotational axis of the image carrying member and the transferred surface of the intermediate transfer body on an upstream side of the cartridge in the mounting direction is larger than that on a downstream side of the cartridge in the mounting direction, and when the guide rail unit is positioned in the lifting position, the image carrying member on the upstream and downstream sides of the cartridge contacts with the transferred surface of the intermediate transfer body.

9. The image forming apparatus according to claim 8, wherein the apparatus main body includes a frame disposed downstream of the cartridge, in the mounting direction, that has been attached to the apparatus main body, the frame including a positioning portion with which a downstream end portion of the cartridge in the mounting direction contacts so as to position the downstream end portion of the cartridge with respect to the frame in an orthogonal direction orthogonal to the rotational axis, and wherein the guide rail unit includes a guide rail and an elastic portion provided on the guide rail, wherein when the guide rail unit is positioned in the lowering position, the elastic portion urges the cartridge against the positioning portion of the frame by being elastically compressed between the cartridge and the guide rail, and when the guide rail unit is positioned in the lifting position, the elastic portion urges the image bearing member against the intermediate transfer body by being compressed between the cartridge and the guide rail.

10. The image forming apparatus according to claim 9, wherein the elastic portion is provided on a downstream side of the guide rail unit, and a surface of the elastic portion is inclined so that a distance, in the vertical direction, between the surface of the elastic portion and the intermediate transfer body becomes smaller as it goes in the mounting direction.

11. The image forming apparatus according to claim 8, wherein the image bearing member is a photosensitive drum.

12. The image forming apparatus according to claim 8, wherein the apparatus main body includes a frame disposed downstream of the cartridge, in the mounting direction, that has been attached to the apparatus main body, the frame including a positioning portion with which a downstream end portion of the cartridge in the mounting direction contacts so as to position the downstream end portion of the cartridge with respect to the frame in an orthogonal direction orthogonal to the rotational axis, and wherein when the guide rail unit is positioned in the lowering position, the downstream end portion of the cartridge contacts with the positioning portion of the frame, and when the guide rail unit is positioned in the lifting position, the downstream end portion of the cartridge contacts with the positioning portion of the frame so as to position the downstream end portion of the cartridge with respect to the frame in the orthogonal direction.

13. The image forming apparatus according to claim 8, wherein the guide rail unit includes a guide rail and first and second elastic portions provided on the guide rail and on which the cartridge is mounted, the second elastic portion being provided downstream of the first elastic portion in the mounting direction and being arranged nearer to the transferred surface of the intermediate transfer body in the vertical direction when the guide rail unit is positioned in the lowering position.

* * * * *